US005129606A

United States Patent [19]

Rodems et al.

[11] Patent Number: 5,129,606

[45] Date of Patent: Jul. 14, 1992

[54] RAILWAY WHEEL SENSORS

[75] Inventors: James D. Rodems, Syracuse; Gary A. Carner, Jamesville; Patrick J. Magari, Baldwinsville, all of N.Y.

[73] Assignee: JDR Systems Corporation, Syracuse, N.Y.

[21] Appl. No.: 666,197

[22] Filed: Mar. 7, 1991

[51] Int. Cl.[5] ..... B61L 1/16

[52] U.S. Cl. ..... 246/249; 246/247

[58] Field of Search ..... 246/122 R, 124, 169 R, 246/246, 247, 249; 238/338

[56] References Cited

U.S. PATENT DOCUMENTS

| | | | |
|---|---|---|---|
| 2,887,179 | 5/1959 | Steele et al. . | |
| 3,359,416 | 12/1967 | Wilcox | 246/122 RX |
| 3,504,173 | 3/1970 | Brinker | 246/247 X |
| 3,569,920 | 3/1971 | Campbell | 246/249 |
| 3,581,084 | 5/1971 | Kaneo et al. | 246/249 |
| 3,964,703 | 6/1976 | Wilkas et al. | 246/249 X |
| 4,200,855 | 4/1980 | Gilcher | 246/249 X |
| 4,200,856 | 4/1980 | Gilcker | 246/249 X |
| 4,214,647 | 7/1980 | Lutts . | |
| 4,346,785 | 8/1982 | Frank . | |
| 4,489,809 | 12/1984 | Wade . | |
| 4,520,901 | 6/1985 | Borup et al. . | |
| 4,556,127 | 12/1985 | Doorley et al. . | |
| 4,701,866 | 10/1987 | Harrison et al. | 246/249 X |
| 4,702,104 | 10/1987 | Hallberg | 246/169 R X |
| 4,781,060 | 11/1988 | Berndt | 246/169 R X |
| 4,856,617 | 8/1989 | Lounsberry . | |

FOREIGN PATENT DOCUMENTS

| | | | |
|---|---|---|---|
| 1455358 | 1/1969 | Fed. Rep. of Germany | 246/249 |
| 55692 | 5/1967 | German Democratic Rep. | 246/249 |

*Primary Examiner*—Robert J. Spar
*Assistant Examiner*—Scott L. Lowe
*Attorney, Agent, or Firm*—Watson, Cole, Grindle & Watson

[57] ABSTRACT

The invention concerns a system for sensing train wheels which employs a slotted detector bar. Optical resistive and piezoresistive strain gauges may be coupled to the detector bar as well as enhanced mechanical and electrical components. Optional equipment including an optical sensor, and pulse and frequency modulators improve noise immunity and reduce power consumption.

25 Claims, 5 Drawing Sheets

L
L1
T
48
42

105
188
190
186
182
180
184

F
204
208
207
214
206
209
202

PROCES CCONTROLLER
FREQUENCY DEODULATOR
234
238
INTERCONNECT CABLE
236
220
WHEEL SENSOR ELECTRONICS
FREQUENCY MODULATOR
232
230
228
STRAIN GAGE
222
AMPLIFIER
224
DIGITAL SAMPLE & HOLD
CLOCK
PULSE MODULATOR
226

202
209
206
204
210
LASER DIODE
212
THRESHOLD

RAILWAY WHEEL SENSORS

BACKGROUND OF THE INVENTION

This invention is directed to problems associated with railway wheel sensors and applications therefor. In particular, the invention relates to means for sensing the passage of railway rolling stock past a specified portion of the track where responsively coupled wayside equipment is normally located. For example, in modern lubricating systems, lubricant such as grease is dispensed onto the track or the flange wheels of the railway rolling stock to assure that wear on the curved sections of track is minimized. The technique requires that the proper amount of lubricant be dispensed and this varies with the length of the train and the consequent number of wheels involved.

Hot box detectors sense overheated journal boxes on passing trains and, using wheel count as a guide, defective equipment is located for repair at a later time. Here accurate wheel count is essential to locating the faulty journal box.

Train detectors for producing a warning signal at a grade crossing also rely on accurate, false alarm free train detection systems. In such applications accurate and unambiguous detecting means is an important feature.

Various transducers have conventionally been employed to sense or detect the number of wheels on moving trains. Examples include simple pressure sensitive switches tripped by the flange wheels of a passing train and more sophisticated electronic devices such as optical and magnetic pickups. One known system employs a low output resistive strain gauge in one leg of a bridge circuit feeding a differential amplifier pair and a high gain amplifier.

Such systems are largely unattended and are exposed to all kinds of weather conditions and to industrial environments. It is thus not surprising that the sensing system must be rugged in order to avoid environmentally induced failures. Physically exposed elements of railway systems, such as the sensor itself, may well become damaged through normal wear and tear and may be rendered inoperative by virtue of adverse weather conditions acting upon the exposed equipment. In particular electrical components are particularly sensitive to adverse environmental conditions and may also be affected by electrical or magnetic interference. Overhead power lines or those adjacent to track, or high voltage sources giving rise to electrical and magnetic disturbances are often encountered. In addition weather related magnetic interference such as lightning induced surges may also affect system performance.

Some of the known systems attempt to obviate the problems outlined above. Previous efforts required welding or permanently attaching the gage to the rail. Such arrangements are impractical because they are too costly to implement.

The known system employing a low output (gage factor) resistive strain gauge required a fairly high gain amplifier, in the order of 85 db, to unambiguously detect a train wheel. Unfortunately, such high gain amplifiers are especially susceptible to noise or electromagnetic interference (EMI) and may therefore produce a false alarm. In order to assure a positive detection a high gain amplifier is required, because the transducer may experience only a small deflection. This translates into a small change in resistance resulting in a relatively small input signal. This is especially true in light rail applications particularly those using concrete ties and in mining operations where the cars are empty. In the described arrangement, the resistive strain gauge is mounted onto a uniform thickness bar which experiences uniform deflection with passing load. It is thus difficult to sense a stress induced signal.

Added difficulties arise because conventional systems require on site adjustment or calibration during set up to provide the requisite sensitivity for proper detection. This results in the need for skilled personnel to effect the initial installation and sensitivity adjustments and to effect subsequent adjustments as may be needed.

SUMMARY OF THE INVENTION

The invention concerns a system for sensing train wheels which overcomes the problems of the described prior arrangements. The invention is particularly concerned with an improved form of a sensing and detecting system. which has enhanced sensitivity resulting from a slotted sensing bar.

In one form, the invention employs an improved semiconductive strain gauge which produces a highly sensitive output signal.

In another form, the invention employs selective amplification for various applications and desired levels of sensitivity.

Improvements are disclosed which concern the mechanical aspects of sensor systems but these are closely associated with electrical improvements in the sensing components. In one aspect, the invention concerns a system in which the sensor is disposed beneath the rail in a physically enhanced housing and is protected from adverse ambient conditions.

In another aspect, the invention concerns the use of a sensor which incorporates a strain gauge bonded to the bottom face of a slotted plate which upper face is clamped solidly to the bottom face of a railway flange.

In another aspect of the invention, the sensor is made by welding the ends of the plate to clamping elements and thereafter securing the clamping elements to a fixture with the slotted side of the plate face-to-face to a portion of the fixture simulating a railway flange. The slotted bar is thereby pre-stressed to its intended working position. Thereafter a strain gauge element is bonded to the unslotted face of the plate while the plate is so flattened. The result is that the strain gauge is substantially devoid of any pre-stress in the intended working position. When removed from the manufacturing fixture and reinstalled on a railway flange the strain gauge is likewise unstressed.

In an embodiment of the invention the strain gauge is integrated with a relatively low gain amplifier designed to incorporate four legs of a Wheatstone bridge, one leg being the strain gauge having a nonlinear but predictable resistance value. The amplifier is responsive to stress induced changes in the strain gauge resistance caused by passing rolling stock. The changing resistance causes an imbalance in the Wheatstone bridge to produce an output signal swing as the wheels pass over the rail section beneath which the plate is clamped and positioned. The combination of the slotted plate and the nonlinear strain gauge results in higher detector sensitivity than conventional devices which thereby permits the use of a reduced gain amplifier to produce an output signal. The amplifier has, as a result of the reduced gain, increased immunity from electromagnetic interference which can cause false detections.

Another aspect of the invention concerns the provision of a below track electronic sensor system which is electrically coupled to the track or rail only by stray capacitance of picofarad value. The electronic sensor system is therefore substantially isolated electrically from the track such that it is insensitive to electrical phenomena such as lightning induced surges in the track, electrical signals transmitted along the track, electric rail systems, and the like.

In another aspect of the invention, the electronic sensor system lends itself to enhanced magnetic shielding, and for this purpose utilizes a mu-metal and copper screen, gasket between the cover and the housing for the electrical components.

Another aspect of the invention employs enhanced amplifier components with increased common mode and power supply rejection characteristics which increase the signal to noise ratio of the output signal.

The sensor employs a dc power supply which is adapted for ac operation by means of an alternating current input circuit, thereby allowing use of line power when available.

In another embodiment an optical fiber detector is employed.

In accordance with the invention input resistance to the amplifier circuit is reduced in order to render the amplifier circuitry less susceptible to EMI.

Increased power consumption resulting from such reduced input resistance is compensated for by means of pulse modulation or duty cycle control of the amplifier power supply.

DESCRIPTION OF THE INVENTION

Figure 1:
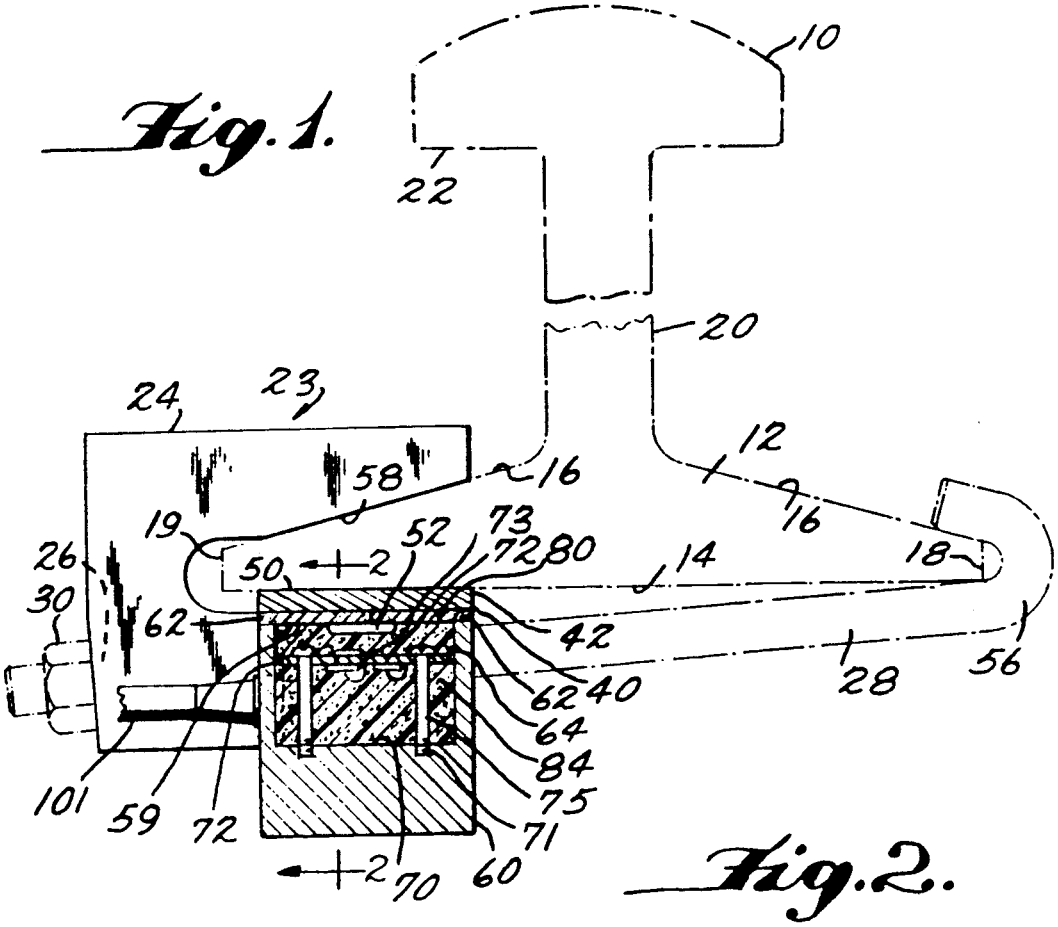
FIG. 1 is a sectional view of the railway sensor assembly of the invention and showing a fragmentary portion of a rail section to which the assembly is applied in phantom lines.

By way of background, reference is directed to FIG. 1 which illustrates in phantom lines a fragmentary view of a rail 10 which, includes a flange 12 adapted to rest upon and be secured to a railroad tie (not shown). The flange 12 has a flat bottom 14 sloped upper side surfaces 16 and end portions 18 and 19. Upstanding web portion 20 is connected to the flange 12 and is surmounted by the head or rail portion 22 upon which the flanged wheels (not shown) of railway rolling stock are supported.

In accordance with the invention, there is provided a wheel detector 23 including rail clamps 24 having apertures 26 therein (FIG. 2) for receiving associated J hooks 28 therethrough and with securing nuts 30 are used to secure the sensor of the invention to the rail 10. A sensor 40 is secured to the clamps 24 and includes a slotted detector bar 42 extending between the clamps 24 a welded at its opposite ends 44 by paired weldments 46. The bar 42 has a transverse slot 48 formed in the upper surface 50 thereof. A strain gauge 52 is secured to the lower surface 54 of the bar 42 opposite the slot 48.

In normal use, the sensor 40 is secured to the rail flange 12 in a conventional manner by means of the clamps 24 and the associated J hooks 28. End portions 56 of the J hooks engage end portion 18 of the rail 10 and the open side 58 of the clamps 24 engage the slope surface 16 and the bottom surface 14 at the opposite end portion 19 of the rail 10. It is important that as the securing nuts 30 are tightened, the slotted upper surface 50 of the detector bar 42 is clamped flat against the bottom surface 14 of the rail 10.

A rigid cover 60 having an open top portion 62 and cavity 64 is secured to the underside 54 of the bar 42 by bolts 66 and nuts 67 which engage a stepped surface 68 of the cover 60. A resilient washer 69 is interposed between the nuts 67 and the stepped surface 68 in order to mechanically decouple the rigid cover 60 from the bar 42. The cover 60 has a bottom wall 70 with blind threaded apertures 71 formed therein. A printed circuit board 72 including electrical components 73 of a control circuit, discussed hereinafter, is mounted, component side down, as shown, to the bottom wall 70 of the cover 60 by means of screws 75. The screws 75 pass through apertures 76 in the circuit board 72 and are threadably located in the blind holes 71 as shown. The arrangement secures the circuit board 72 into the cover 60 without employing threaded through openings exterior of the cover 60. A gasket 80 is located between the open top 62 of the cover 60 and the bar 42 for hermetically sealing the circuit board 72 and the strain gauge 52 in the cavity 64.

Epoxy based potting compound 84 fills the cavity 64, completely submerges the printed circuit board 72 and encapsulates the components 73 and traces (not shown). The potting compound 84 absorbs vibrations to further isolate the circuitry from adverse mechanical impacts and the like. The potting compound 84 prevents moisture penetration to the printed circuit board 72, and components 73 which is a common serious problem.

Figure 3:
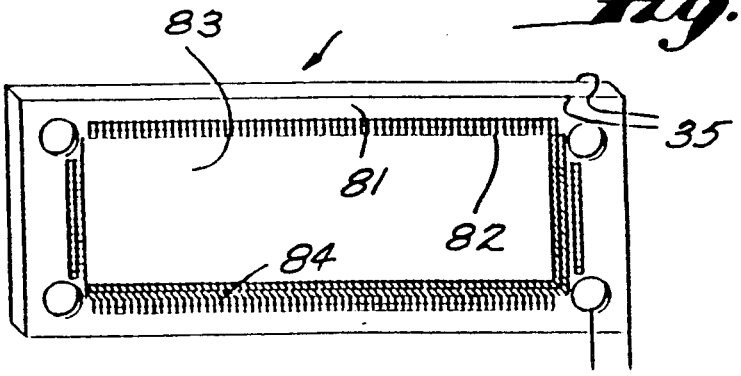
FIG. 3 is a perspective view of a gasket employing an EMI suppression screen for use in the present invention.

FIG. 3 illustrates the gasket 80 in schematic perspective view. The gasket 80 employs electrical enhancements for suppressing EMI and is formed of a compressible body 81 having an opening 83 therein conforming to the open top 62 of the cover 60. A mu-metal and copper screen 84 is formed in the opening 82 and on opposite planar faces 85 thereof. When the gasket 80 is installed, the body 81 is compressed between the lower side 54 of the bar 42 and the open top 62 of the cover 60. The screen 84 shields the components from EMI at the seam between the cover 60 and bar 42.

Figure 5:
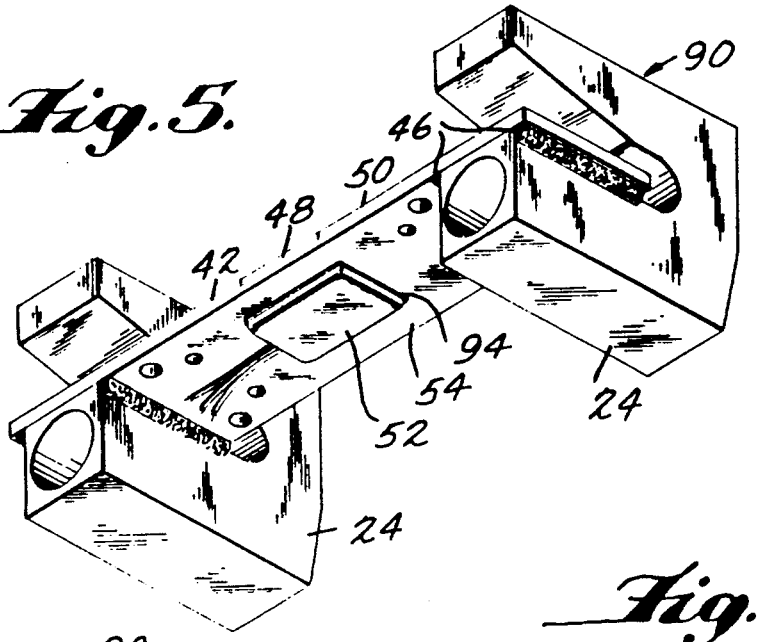
FIG. 5 is a perspective view of a portion of the railway sensor assembly of the present invention.
Figure 4:
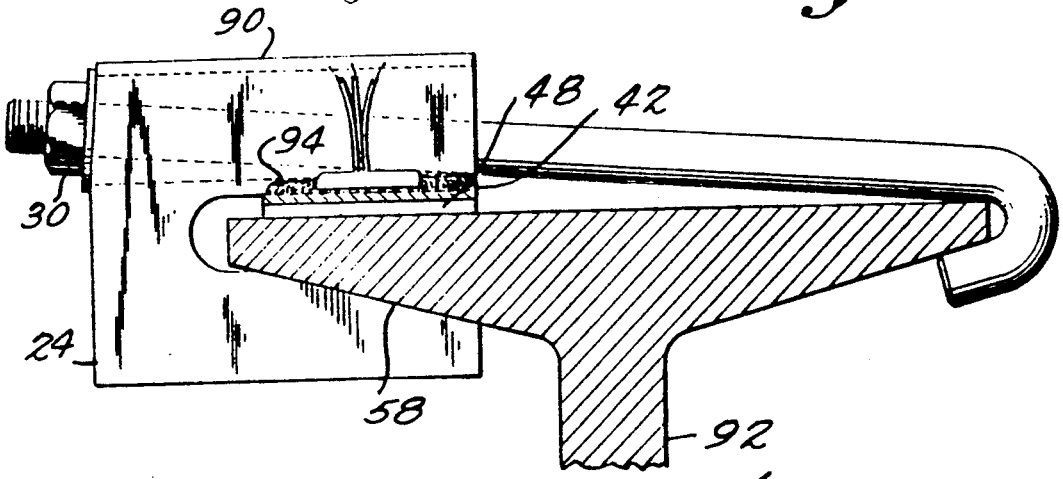
FIG. 4 is a sectional view of a partial sensor assembly coupled to a rail simulator or manufacturing fixture.

In accordance with the invention the bar 42 may be a high carbon steel plate, but could also be a stainless steel plate, which is clamped flat against the bottom surface 14 of the rail 10 enhances sensor reliability because of the inherently superior resistance of stainless steel to corrosion. Stainless steel also recovers the bar strength lost by use of the transverse slot 48. A partial assembly 90 is shown in FIGS. 4 and 5. In FIG. 4, the bar 42 and the clamps 24 may be secured to a manufacturing fixture 92 by means of the J hooks 28 and securing nuts 30. The manufacturing fixture 92 resembles in cross section an inverted portion of the rail flange 12 (FIG. 1). The partially assembled structure 90 is attached to the fixture 92 in the same way that the fully assembled detector 23 is attached to the rail 10 as discussed above.

The various manufacturing steps including welding the bar 42 to the clamps 24 may induce internal stresses in the bar. However, as long as the bar 42 is maintained flat against the upper surface of the fixture 92 while the strain gauge 52 is attached to bar 42, such stresses are irrelevant. Thus, when the final assembly 23 is mounted on the rail 10 manufacturing induced stresses are overcome by the forces associated with proper field installation. In this stage of the manufacture, the strain gauge 52 is cemented on the side 54 of the bar 42 opposite the slot 48 by means of a layer of epoxy resin 94. Under these conditions the strain gauge 52 is unstressed and when reinstalled on the rail 10 is likewise unstressed. The intent of the assembly fixture 92 is to remove the effect of bar pre-stress on the strain gauge 52, when the gage 52 is cemented to the bar 42 of the partial assembly 90.

Figure 6:
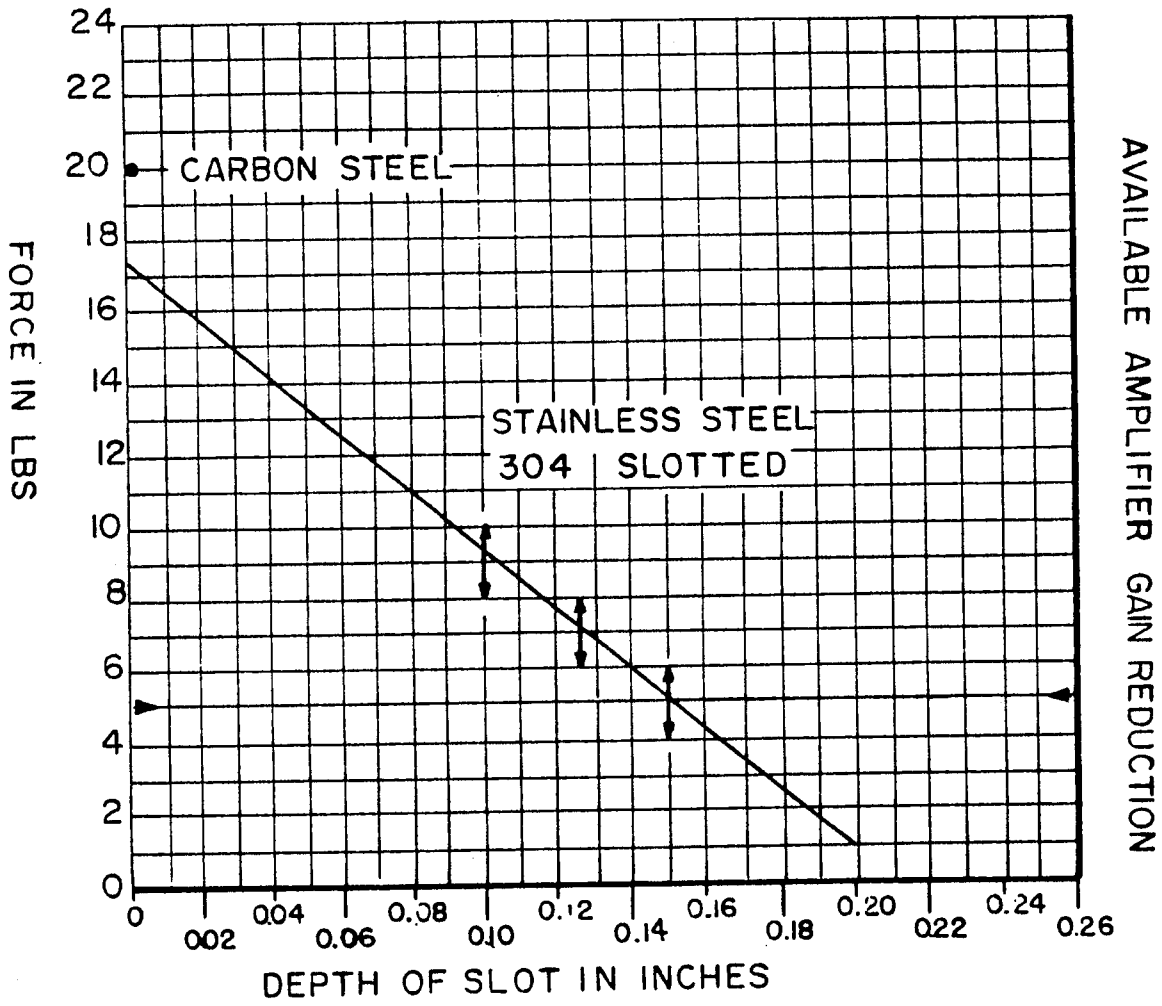
FIG. 6 is a plot of force necessary to activate the control circuit versus slot depth and available amplifier gain reduction.

FIG. 6 is a plot of the force to actuate the control circuit versus the depth of the slot 48 in the bar 42 having a nominal thickness of 0.25". Also plotted is the reduction in amplifier gain in connection with the slot depth. The force on the bar without a slot necessary to actuate the control circuit is about 20 lbs and the required amplifier gain is about 85 db. The curve shows that the force to actuate the controller decreases with increasing slot depth. Consequently, the amplifier gain may be reduced without adversely effecting the sensitivity of the system. For a preferred 0.15" slot the force is about 5 lbs and the amplifier gain is reduced by about 12 db. Amplifier gain reduction renders the system less susceptible to false alarms and EMI.

Figures 7, 9, 10, 11, 12:
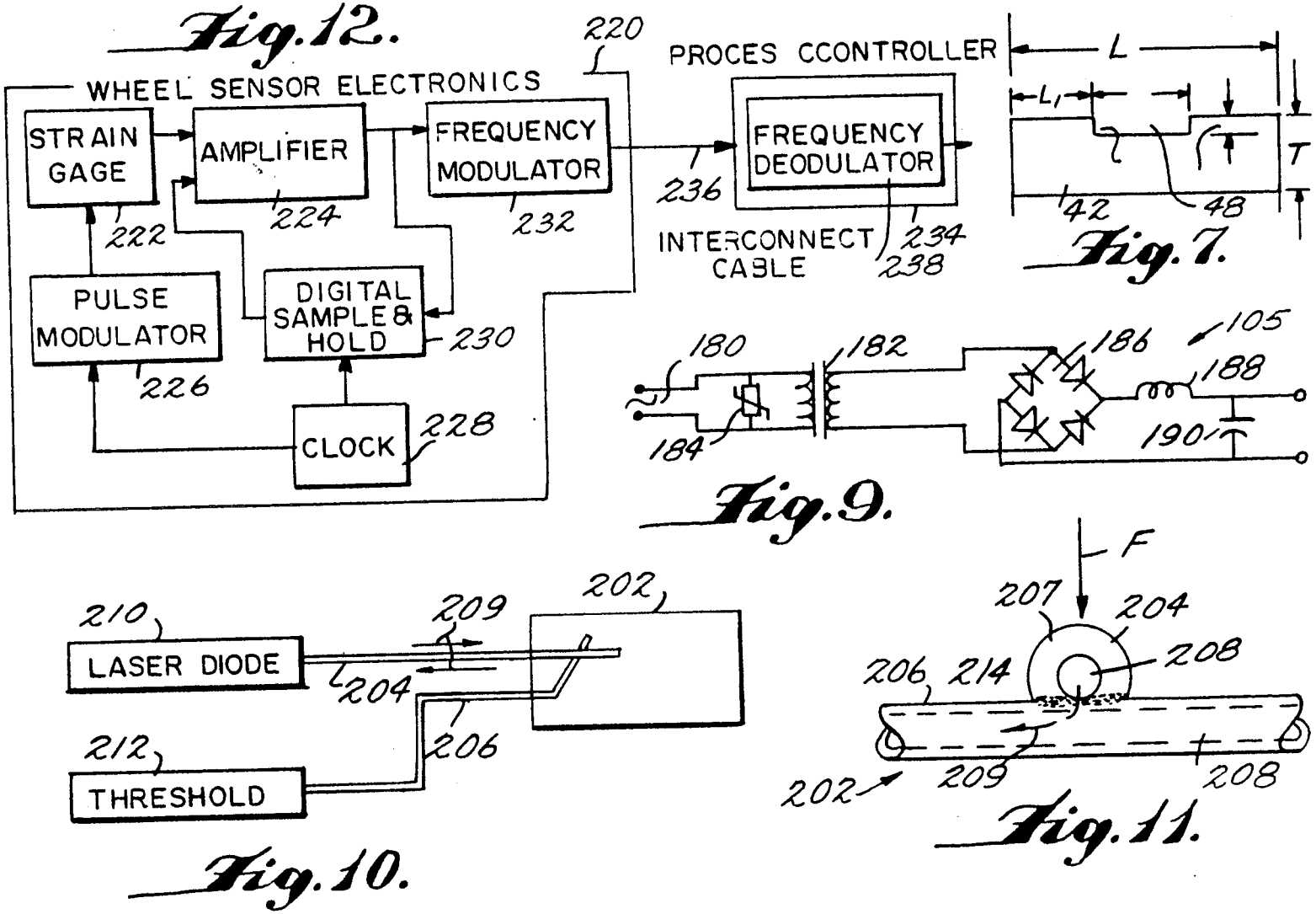
FIG. 7 is a fragmentary sectional view of the slotted detector bar employed in the present invention.
FIG. 9 is an illustration of an exemplary alternative AC supply circuit for the circuit shown in FIG. 8.
FIG. 10 is a schematic block diagram of an optical detection system according to the invention.
FIG. 11 is a detail of the optical detector shown in FIG. 10.
FIG. 12 is a schematic block diagram of an embodiment of the invention employing signal modulation means.

FIG. 7 illustrates in fragmentary cross section the bar 42 and the slot 48 with dimensions labeled. The sensitivity of the detector bar 42 increases in accordance with the following expression:

$$\frac{E_s}{E_o} = \frac{LT^2}{[d^2(2^{Li} + 1T^3/d^3]}$$

Where:

$E_o$ = strain of the unslotted bar
$E_s$ = strain of the slotted bar
L = length of the bar
T = thickness of the bar
d = depth of the slot
Li = length from the end of the bar to the slot
l = width of the slot In a preferred embodiment the slot 48 is machined with a $\frac{1}{8}$" radius R and is thereafter shot peened to clear away tool marks and prevent stress corrosion and to prevent fatigue failure.

Figure 2:
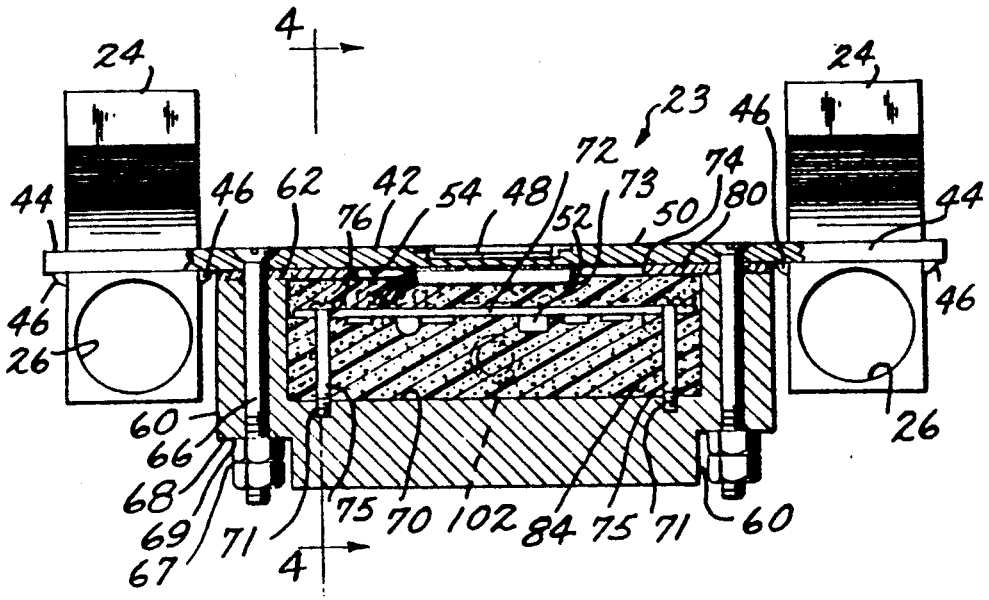
FIG. 2 is a longitudinal section of the sensor assembly shown in FIG. 1 taken along lines 2—2 thereof.
Figure 8:
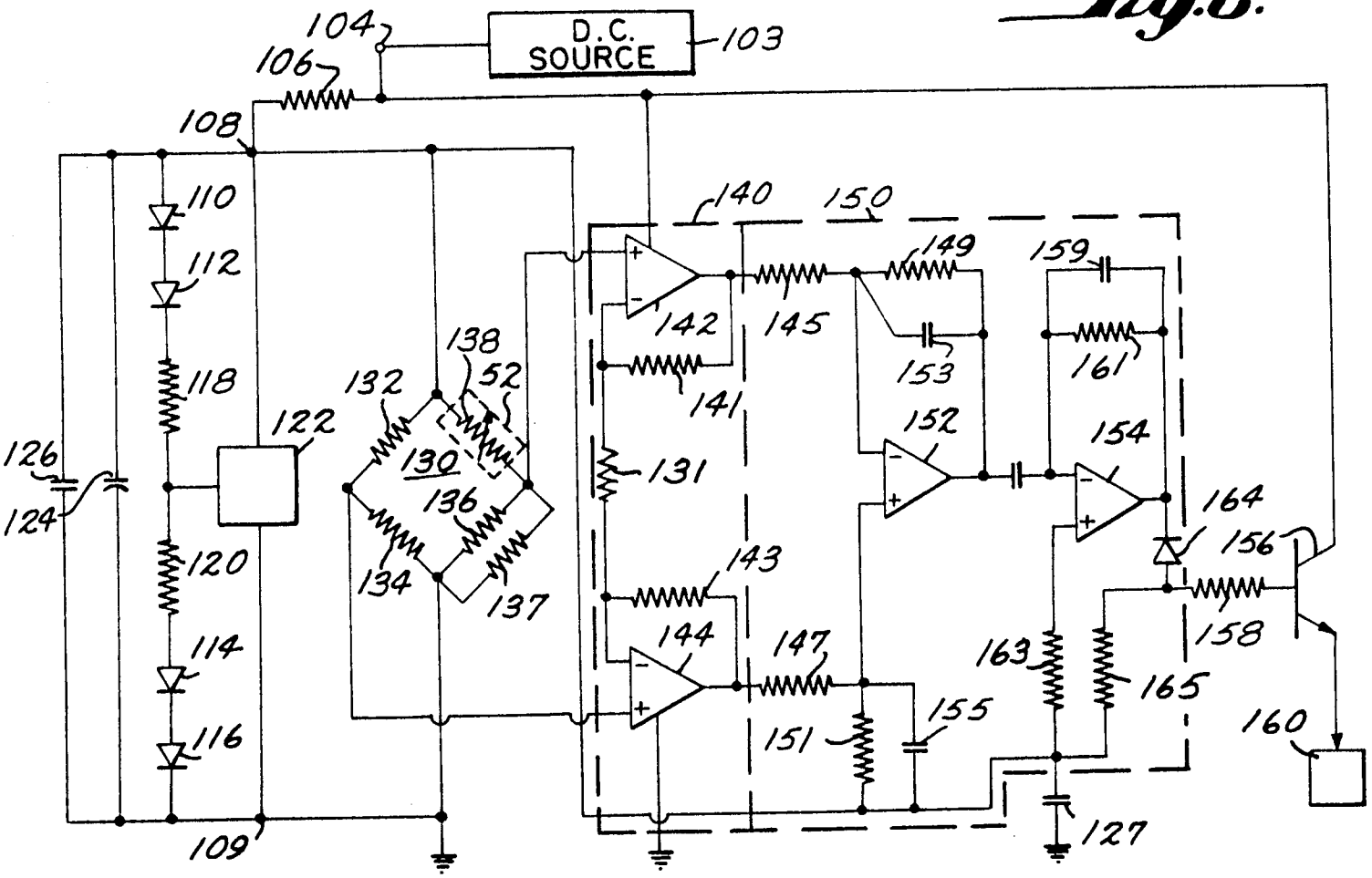
FIG. 8 is a schematic circuit diagram for use in the sensor assembly according to the invention.

The circuit board 72 supports a control circuit 100 illustrated schematically in FIG. 8. The circuit 100 is responsively coupled to strain gauge 52 for producing an output signal indicative of a passing train wheel. The control circuit 100 is coupled to wayside located equipment (not shown) by shielded cable 101 secured in aperture 102 of the cover 60 (FIGS. 1 and 2).

In FIG. 8, it will be understood that the circuit 100 operates from a +12 V DC supply 103 connected to supply terminal 104. Alternatively, a rectified AC supply 105 illustrated in FIG. 9 may supply +12 V DC at terminal 104. A dropping resistor 106 is coupled to the supply 103 to supply +5 V DC across lines 108 and 109. Diodes 110, 112, 114, 116 and resistors 118 and 120 operate in conjunction with the regulator chip 122 and the capacitors 124 and 126 to maintain a regulated +5 V across the lines 108 and 109, as shown. The capacitor 126 is a small disc ceramic capacitor as is capacitor 127 provided for RF noise control purposes. A Wheatstone bridge circuit 130 is coupled across the lines 108 and 109 and includes fixed resistors 132, 134, 136 and 137 and the nominal resistance 138 of the strain gauge 52. Resistors 132 and 134 have equal values. Resistor 137 is in shunt with resistor 136. The parallel resistance of the resistors 136 and 137 equals the nominal resistance 138 of the strain gauge 52.

A differential amplifier circuit 140 including amplifier components 142 and 144 are coupled across the Wheatstone bridge 130 as shown. Amplifier circuit 150 including amplifier components 152 and 154 are used to develop a signal at the base of output transistor 156 through diode 164 and base resistor 158 which controls a separate circuit board controller 160. By establishing the value of the strain gauge resistor 138 at that value which it exhibits in a no-stress or no-strain condition, different strain gauges 52 will exhibit substantially the same resistance value so that the electronic circuit shown in FIG. 8 may be manufactured with the same nominal values noted in the accompanying table. Different sensors will exhibit the same sensitivity to the presence of rolling stock on an active portion of a rail section 10 when in use with the assembly firmly clamped in place. There is no need for adjustable components in the circuitry of FIG. 8 because of this uniformity in the operative, no-strain value of the resistance 138.

The circuit 100 is relatively immune to noise and is well compensated for temperature. The circuit 100 incorporates a signal ground at the control board controller 160 so that it is well isolated from extraneous interference. The circuit is only lightly capacitively coupled to the rail section 10 (FIG. 1). This coupling is only about 40 picofarads mainly due to stray coupling between the strain gauge resistance 138 and the rail section 10. Consequently, even if extraneous electromagnetic fields couple to the rail due to the proximity or intensity of the source, there is little likelihood that the circuit 100 will suffer adverse electromagnetic interference.

The strain gauge 52 may be a resistive element having a linear resistive characteristic or may be a semiconductive device exhibiting the piezoresistive effect. In the case of a piezoresistive element, the strain gauge couples a change in length of the bar 42 nonlinearly to a change in resistance according to the formula:

$$\frac{\Delta R}{R} = \frac{T_o}{T} C_1 E + \frac{T_o}{T^2} C_2 E$$

Where:

$C_1$ = Linear strain sensitivity constant $C_2$ = Piezoresistive strain sensitivity constant $T_o$ = Absolute reference temperature T = Actual temperature E = Strain At temperatures expected in the wheel sensor environment, e.g. −40° F. to 120° F., a gauge based on the piezoresistive effect exhibits neither hystersis nor creep. Fatigue life is superior to common bonded resistive ribbon strain gauges. The piezoresistive strain gauge of the invention exhibits an improved gauge factor of about 115 min. The gauge factor is determined by the response of the strain gauge in inches of deflection of the bar per inch. The improved gauge factor results in a reduction in required amplifier gain of about 37 db. When combined with the preferred slotted bar 42, the overall gain reduction is about 49 db which results in an amplifier gain requirement of about 36 db. The total amplification or gain provided by amplifiers 140 and 150 may thus be relatively low which thereby renders the circuit 100 virtually immune to EMI. Accordingly, the system is highly false alarm free.

Another improvement in the invention is achieved by reducing the input impedance to the amplifier 140 by lowering the bridge resistors 132, 134 to about 150–200 ohm. When this is done, input noise is significantly reduced due to the small voltage drop across the bridge 130.

It should be understood that by employing the various types of strain gauge with different amplification gain conditions in combination with the slotted detector bar, many application needs may be met. For example, in standard applications, e.g. rail lubrication and grade crossings, a resistive strain gauge and a standard high gain amplifier may be employed with the slotted bar. For other applications where exact wheel counts are crucial as in hot box detection, the piezoresistive strain gauge may be employed with a low gain amplifier. In applications where detection is particularly difficult, such as rapid transit and mining operations, the latter combination of elements may also be used.

When train speed is slow, sensitivity is reduced. The present invention is capable of low speed above 1 MPH) wheel detection with great reliability. With circuit elements optimized for speeds below 1 MPH, high speed reliability near 100 MPH may be reduced. However, different applications may be readily accommodated by selection of the circuit elements. Alternatively, the circuit arrangement illustrated in FIG. 12 (hereinafter described) may be used to provide detection of trains down to zero MPH.

Typical values for the circuit 100 are set forth below:

TABLE

| | |
|---|---|
| Capacitors 126, 127, 153, 155 | 0.1 uF/12 V disk ceramic |
| Capacitor 124 | 150 uF/16 V electrolytic |
| Capacitor 167 | 10 uF/25 V non-polarized electrolytic |
| Capacitor 159 | .05 uF/12 V disk ceramic |
| Strain gauge resistance | 350 ohm 0.2 nominal (A) CEA-09-125UW-350 Gauge factor 2.130IV.5% |
| Dropping resistor 106 | 560 ohm |
| Resistors 118, 120 | 5.1K ohm |
| Resistors 132, 134 | 10K ohm, .1%, ¼ W |
| Resistor 136 | 1050 ohm, 1% |
| Resistor 131 | 150 ohm, 5% |
| Resistors 141, 143 | 10K ohm, 1% |
| Resistors 145, 147, 149, 151 | 100K ohm |

TABLE-continued

| | |
|---|---|
| Resistor 161 | 1M ohm, 5% |
| Resistor 158 | 1K ohm |
| Resistors 163, 165 | 10K ohm |
| Resistor 137 | 523 ohms, 1% |
| Chip 122 | National LM236H-5.0 (B) |
| Chips 142, 144, 152, 154 | National LM224AN (B) |
| Diodes 110, 112, 114, 116 and 164 | 1N4002 Diode |
| Transistor 156 | 2N3904 NPN Transistor |

(A) MIL S 19500

(B) MIL standard 883B, Class B, Testing screening wire and cabling MIL C17

Optional MIL specifications require components and testing that reduce initial failure rates and improve field reliability.

FIG. 9 illustrates a full wave AC rectified circuit 104 which may be employed in areas where AC line power is available. AC power from an AC source 180 is coupled by transformer 182, protected by a transient protection device such as metal oxide varistor 184, to full wave bridge 186. The rectified DC output is coupled to the power input 104 by ripple filter including inductor 188 and capacitor 190.

FIG. 10 illustrates in schematic block form a detector circuit 200 employing an optical strain gauge 202 in which a pair of fibers 204, 206 carry a pressure modulated light signal 209 from laser diode 210 to threshold detector 212. As shown in FIG. 11, the fibers 204, 206, each having a core and cladding 207, 208, are mounted in intimate contact by means of a flexible optically clear adhesive 214. Preferably the cladding 207 of the fibers 204, 206 is abraded at the point of contact, so that the light 209 is coupled from fiber 204 to fiber 206 in accordance with the wheel force F. The optical strain gauge 202 may be mounted on a slotted bar to increase sensitivity as well as enabling the detection of trains below 1 MPH. The arrangement allows the strain gauge 202 to be remotely spaced from the electronics for increased noise immunity.

FIG. 12 illustrates in schematic block form a wheel sensor circuit 220 which employs duty cycle and frequency modulation techniques for reducing power consumption and improving noise immunity. The strain gauge 222 provides an output to amplifier 224 which amplifies signal to a useful level.

A pulse modulator 226 driven by a clock 228 pulses the strain gauge 222 at a selected pulse rate for periodically enabling it. Digital sample-and-hold circuit 230 coupled to the amplifier 224 is likewise periodically enabled by the clock 228. The wheel signal, coupled to the amplifier 224, is sampled and held in accordance with the output of the clock 228.

The amplified wheel signal is coupled to frequency modulator 232 which modulates the amplified signal to thereby render it less sensitive to ambient noise. Process controller 234 coupled to the wheel sensor circuit by cable 236 includes a demodulator 238 for effectively decoding the wheel signal. The combination of pulse modulation and frequency modulation reduces power consumption and increases noise immunity and allows detection of trains travelling below 1 MPH, e.g. zero MPH.

While there has been described what at present is considered to be the preferred embodiment of the present invention it will apparent to those skilled in the art that various changes and modifications may be made therein without the departing from the invention and it is intended in the appended claims to cover all such changes and modifications as forward in the true spirit and scope of the invention.

What is claimed is:

1. A sensing and detecting system for railway train wheels comprising:

a detector bar of compliant material having a transverse slot therein, said bar becoming deformed in response to a deflecting force said deformation occurring to a greater extent in the vicinity of the slot than in portions of the bar adjacent the slot;

means at opposite ends of the bar for securing the bar against a bottom face of a section of railway rail in service without mechanical adjustments required;

strain gauge means having a variable characteristic affixed to the detecting bar in operative relation to the slot for providing a change in the characteristic of said strain gauge means in response to deformation of the section of railway rail in service to which the bar is secured; and amplifier means connected to the strain gauge means for producing a sensible output signal in response to the change in its characteristic caused by deformation of the strain gauge means due to passage the wheels of rolling stock over the section of railway rail in service without electrical adjustments required.

2. A sensing and detecting system as defined in claim 1 wherein the characteristic of the strain gauge means is piezoresistive.

3. A sensing and detecting system as defined in claim 2 wherein the strain gauge is a piezoresistive semiconductive element.

4. A sensing and detecting system as defined in claim 1 wherein the amplifier has a relatively low gain for reducing sensitivity to electromagnetic interference.

5. A sensing and detecting system as defined in claim 4 wherein the amplifier has a gain of about 36 db.

6. A sensing and detecting system as defined in claim 1 further comprising pulse modulation means coupled to the strain gauge means and the amplifier means for periodically enabling the amplifier means to produce the sensible output.

7. A sensing and detecting system as defined in claim 6 wherein the modulation means includes a sample and hold circuit coupled across the amplifier for periodically sampling the change in the strain gauge characteristic, and a clock for driving the sample and hold circuit in accordance with a clock output.

8. A sensing and detecting system as defined in claim 7 wherein the pulse modulation means includes a pulse modulator responsive to the clock and being coupled to the strain gauge means for periodically enabling said strain gauge means in accordance with said clock output.

9. A sensing and detecting system for wheels of railway rolling stock comprising:

a slotted detector bar having a top face with a transverse slot, a bottom face, a predetermined stiffness overall and a lesser stiffness in the vicinity of the slot;

a strain gauge having a variable characteristic bonded to the bottom face of the detector bar opposite the slot;

means for wedging the top face of the detector bar tightly into face-to-face contact beneath a base of a section of railway track in service;

electronic circuit means electrically connected to the strain gauge and electrically connected to the track only by stray capacitance across the strain gauge; and cover means secured to the detector bar for defining an electromagnetically shielded enclosure for the electronic circuit means.

10. A sensing and detecting system as defined in claim 9 wherein the electronic circuit means includes fixed resistance means defining a Wheatstone bridge with the variable strain gauge, and relatively low gain amplifier means connected across the bridge for producing an output signal in response to flexure of the detector bar due to passage of a train wheel over the section of track in service.

11. A sensing and detecting system as defined in claim 10 wherein the strain gauge is a piezoresistive element having a second order nonlinear resistance characteristic.

12. A sensing and detecting system as defined in claim 11 wherein the detector bar has a selected thickness adjacent the slot and a reduced thickness in the slot in a ratio of about 1.6, a the amplifier gain is reduced by about 12 db.

13. A sensing and detecting system as defined in claim 9 further comprising gasket means including a resilient apertured body disposed between the cover and the detector bar and a conductive screen located in the aperture for suppressing electromagnetic interference.

14. A sensing and detecting system as defined in claim 13 wherein the screen is mu-metal and copper.

15. A sensing and detecting system as defined in claim 9 further including a resilient fastener for securing the cover means to the detector bar for mechanically decoupling the cover from the detector bar.

16. A sensing and detecting system as defined in claim 9 wherein the circuit means includes a printed circuit board and the cover means has a cavity for receiving the circuit means therein, the cavity has a wall portion and blind apertures therein, fasteners located in the blind apertures secure the circuit board to the cover means.

17. A sensing and detecting system as defined in claim 16 further including potting material disposed in the cavity for resiliently supporting the circuit board and sealing the circuit board against moisture.

18. A sensing and detecting system as defined in claim 9, further comprising:

a Wheatstone bridge having first and second, third and fourth nodes, a first resistance leg connected between said first and second nodes, a second resistance leg connected between said second, third nodes, a third resistance leg connected between said third and fourth nodes, and the strain gauge comprises a variable resistance mounted to the slotted detector bar and being electrically coupled between the first and fourth nodes, the first, second and third resistance legs each having a relatively low resistance value substantially the same as the strain gauge resistance value when the strain gauge is substantially unstressed to thereby balance the bridge, means connected to said first and third notes for providing a voltage value at said second and fourth nodes when said first and fourth nodes are connected across said substantially unstressed strain gauge, said strain gauge resistance operative when stressed by application of the load to the detector bar to exhibit a change in resistance with stress for unbalancing the bridge and producing a bridge output and amplifier means for providing a signal in response to the bridge output when the strain gauge is stressed, said low gain amplifier having reduced sensitivity to electromagnetic noise in the low resistance components of the bridge.

19. A sensing and detecting system as defined in claim 18 wherein the amplifier means has a relatively low gain and the strain gauge has a piezoresistive characteristic.

20. A sensing and detecting system for railway train wheels comprising:

a detector bar of compliant material having a transverse slot therein, said bar becoming deformed in response to a deflecting force said deformation occurring to a greater extent in the vicinity of the slot than in portions of the bar adjacent the slot;

means at opposite ends of the bar for securing the bar against a bottom face of a section of railway rail in service;

strain gauge means having a variable characteristic affixed to the detecting bar in operative relation to the slot for varying the characteristic in response to deformation of the section railway rail in service to which the bar is secured; and amplifier means connected to the strain gauge means for producing a sensible output signal in response to the change in the characteristic caused by deformation of the strain gauge means due to passage the wheels of rolling stock over the section of railway rail in service.

21. A sensing and detecting system as defined in claim 20 wherein the strain gauge means is an optical device including a pair of optical fibers, said fibers being optically coupled together at one end at the detector bar and the amplifier means being remotely coupled to the detector bar at another end of one said fibers.

22. A sensing and detecting system as defined in claim 21 wherein the optical fibers each have a core for carrying a light signal and a cladding for containing the light signal therein and a portion of the cladding of at least one fiber being removed, said fibers being optically coupled by intimate contact where said cladding is removed so that the light signal can be communicated from one fiber to the other.

23. A sensing and detecting system as defined in claim 21 wherein the contact of the fibers is responsive to pressure between the fibers and the light signal intensity varies with such pressure.

24. A sensing and detecting system as defined in claim 21 further including an optically clear adhesive for connecting the fibers in intimate contact.

25. A sensing and detecting system as defined in claim 1 wherein the characteristic of the strain gauge means is optical.

* * * * *